US011679360B1

(12) United States Patent
Skinner

(10) Patent No.: US 11,679,360 B1
(45) Date of Patent: Jun. 20, 2023

(54) CHEMICAL INJECTION UNIT FOR DRILLING OPERATIONS

(71) Applicant: Jack Lindon Skinner, Butte, MT (US)

(72) Inventor: Jack Lindon Skinner, Butte, MT (US)

( * ) Notice: Subject to any disclaimer, the term of this patent is extended or adjusted under 35 U.S.C. 154(b) by 543 days.

(21) Appl. No.: 16/743,243

(22) Filed: Jan. 15, 2020

Related U.S. Application Data

(60) Provisional application No. 62/793,439, filed on Jan. 17, 2019.

(51) Int. Cl.

| | |
|---|---|
| ***B01F 23/00*** | (2022.01) |
| ***B01F 23/40*** | (2022.01) |
| ***B01F 23/451*** | (2022.01) |
| ***B01F 25/312*** | (2022.01) |
| ***B01F 35/22*** | (2022.01) |
| ***B01F 35/21*** | (2022.01) |
| ***B01F 35/221*** | (2022.01) |
| ***B01F 35/71*** | (2022.01) |

(52) U.S. Cl.
CPC ..... *B01F 23/49* (2022.01); *B01F 23/451* (2022.01); *B01F 25/312* (2022.01); *B01F 35/22* (2022.01); *B01F 35/2111* (2022.01); *B01F 35/2211* (2022.01); *B01F 35/71805* (2022.01); *B01F 23/483* (2022.01); *B01F 2101/49* (2022.01)

(58) Field of Classification Search
CPC ... B01F 23/49; B01F 35/71805; B01F 25/312; B01F 35/2111; B01F 35/22; B01F 23/451; B01F 35/2211; B01F 23/483; B01F 2101/49
See application file for complete search history.

(56) References Cited

U.S. PATENT DOCUMENTS

| | | | | |
|---|---|---|---|---|
| 4,507,976 | A * | 4/1985 | Banko | G01F 1/24 73/DIG. 3 |
| 5,246,026 | A * | 9/1993 | Proudman | B01F 35/2111 137/101.19 |
| 5,746,238 | A * | 5/1998 | Brady et al. | B01F 35/75 137/101.19 |
| 2012/0279912 | A1* | 11/2012 | McCurdy et al. | B01F 25/31242 285/361 |
| 2016/0101393 | A1* | 4/2016 | Jensen | B60S 3/04 137/599.01 |

* cited by examiner

*Primary Examiner* — Anshu Bhatia
(74) *Attorney, Agent, or Firm* — Mitchell J.W. Vap

(57) ABSTRACT

A chemical injection unit consisting of one or more injection loops that uses a Venturi injector and motorized valve with a control system to isolate chemicals from water until operating conditions are suitable to carry the chemical and water mixture down the main flow pipe. The invention adjusts chemical injection rate to maintain desirable operational properties, including chemical injection rate, chemical concentration, or fluid viscosity. Accurate and real-time injection of chemicals is beneficial for safety as well as economics of the drilling operation in terms of reduced drilling time, efficient use of chemicals, and minimal variation in processing conditions.

13 Claims, 2 Drawing Sheets

CHEMICAL INJECTION UNIT FOR DRILLING OPERATIONS

CROSS-REFERENCE TO RELATED APPLICATIONS

Figure 1:
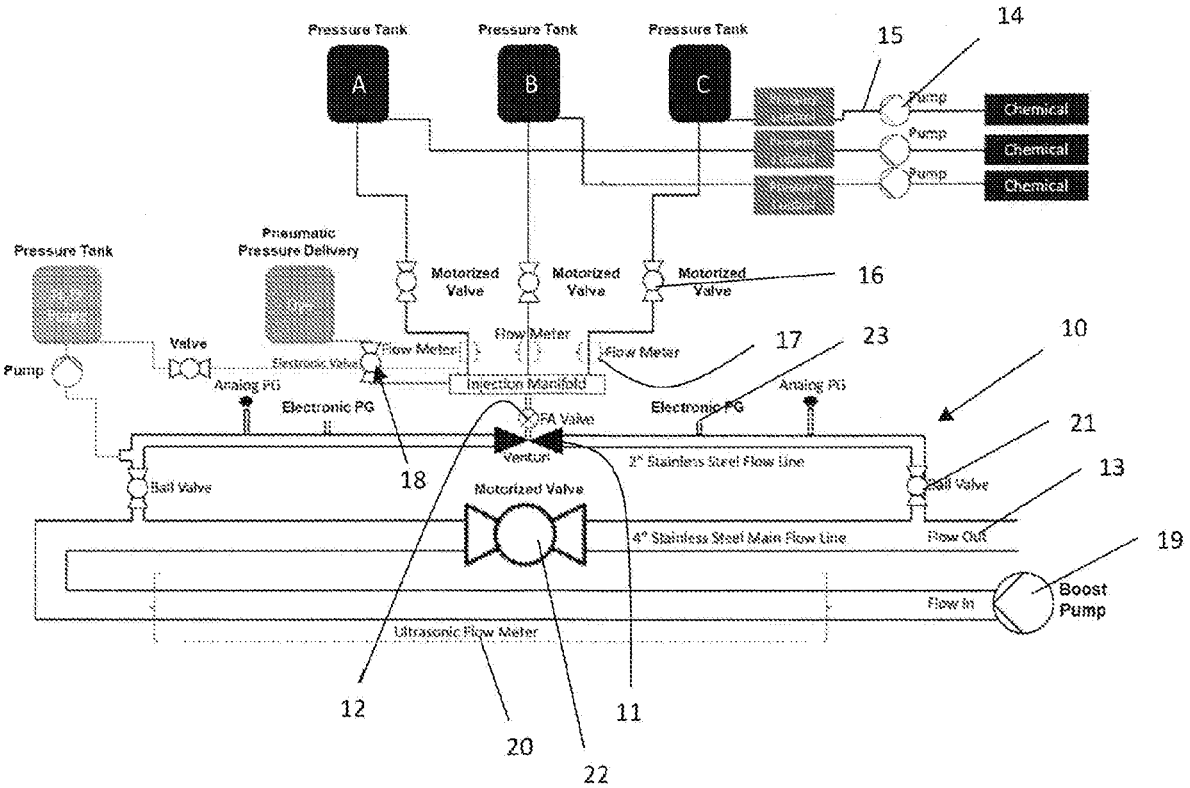

This is a Non-provisional application, which claims priority from U.S. Provisional Application No. 62793439 filed on Jan. 17, 2019, the disclosure of which is incorporated by reference in its entirety to provide continuity of disclosure.

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable.

REFERENCE TO SEQUENCE LISTING, A TABLE, OR A COMPUTER PROGRAM LISTING COMPACT DISC APPENDIX

Not applicable.

BACKGROUND OF THE INVENTION

Chemical injection in the petroleum drilling industry is used for a variety of reasons, and chemical injection materials are formulated for the particular application desired. Chemical injection may be continuous or only performed at a particular stage of the drilling process, requires equipment and materials configured to the well environment and application, and typically involves a combination of hardware and software if accurate monitoring of injection is to be achieved. Accurate monitoring and control over downhole chemical injection is particularly important for safety but also improves economic efficiency and reduces hazardous waste.

Oil and gas drilling operations require chemical injection and monitoring to maintain efficiency and safety. Chemical injection (fluid, gas, or solid) in the petroleum industry is performed to prevent scale or corrosion, to lower fluid friction, to stimulate well production, for fluid injection and pressure testing, to enhance oil recovery, to maintain reservoir pressure, to prevent gas ignition, and to prevent formation other materials, which are toxic to individuals near the operation, among others.

Chemical injection design has experienced several problems in the past, and issues associated with controllable flow through injection lines has been a longstanding issue. In particular, consistent chemical dosing concentration and the fast polymerization (or hydration) of some chemicals used during the injection process has proved problematic for equipment function and longevity.

BRIEF SUMMARY OF THE INVENTION

Described herein is a chemical injection unit comprised of one or more pressurized injection loops that uses a Venturi with a fluid shearing (i.e. mixing) mechanism and fast-acting valve with an algorithm programmed control system to eliminate chemical polymerization until the polymer is swept away in the main flow pipe. The described chemical injection unit adjusts chemical injection based on water flow to maintain a consistent chemical concentration or fluid viscosity, even with varying water flow rates. The chemical injection unit is designed to precisely inject chemicals pertinent to drilling operations, including friction reducers, viscosity modifiers, pipe-on-pipe lubricants, dyes, detergents, breakers, acids, biocides, stabilizers, corrosion inhibitors, surfactants, gelling agents, and scale inhibitors.

In one embodiment, the chemical injection unit is comprised of pumps to build pressure in the chemical lines, metering valves to control flow rates, flow sensors, a fast-acting valve to control chemical exposure to water, solenoid valves to provide quick flow response, an electronic algorithm programmed control system, wireless router, a local wireless network, and custom user interface for remote and local control, monitoring, and data logging.

The chemical injection unit is further comprised of the following system for flow measurement and control: Flow sensors on the chemical lines and a main water flow line suitable for robust flow measurement and minimal clogging issues are used in conjunction with metering valves to provide a consistent chemical concentration injection rate.

The chemical injection unit algorithm programmed control system is further comprised of decision making means for automated control over the system: Ladder logic for control of chemical injection concentration and chemical injection timing. Chemicals that experience polymerization upon contact with water (i.e. friction reducers) cause rapid increases in water viscosity within a timeframe of approximately one minute. The chemical injection unit described herein prevents premature chemical contact with water and subsequent polymerization before the water and chemicals have been directed into the large-diameter water lines. Because of varying flow rates and repeated start and stop cycles of water flow in the drilling process, precise control and management of chemical injection is critical and is accomplished by the control system. When water flow through the large diameter flow lines is present, the pressure drop across a motorized valve is increased through a closing motion. As the valve closes on the main line, water is directed through the Venturi. Once a critical flow rate is present through the Venturi, a negative gauge pressure is created in the injection port of the Venturi. Once this negative pressure is present in the Venturi, the fast-acting valve opens and allows the chemicals in the pressurized chemical lines to move into the high velocity area of the Venturi. This high velocity fluid flow area provides thorough mixing of the chemicals with the water. Friction reducer (FR) typically begins to polymerize upon contact with water. As long as adequate flow through the Venturi exists, the FR/water mixture travels through the injection line and into the main line and into the holding tank or directly into a high-pressure pump for down-hole injection. If fluid flow through the Venturi drops below a critical flow rate where the chemicals will not be drawn into the injection port and subsequently thoroughly mixed and directed into the main flow line, the fast-acting valve closes to prevent the chemicals from having direct contact with the water. Because of the continual starting and stopping of water flow that can be experienced during the drilling process, failure to isolate the chemicals (namely FR) from the water in the pipes leads to polymerization of the FR and the creation of a highly-viscous material that acts as a blockage to flow. Any suitable chemical for injection can be injected with the invention. Examples of chemicals include friction reducers, viscosity modifiers, and pipe-on-pipe, among others. The control system with sensors and actuators measure the pressure drop across the Venturi and directly or indirectly the velocity through the Venturi and opens a fast-acting valve as described above only when adequate flow exists to cause a suction pressure at the chemical injection port. The fast-acting valve is closed upon a decreasing fluid flow through the Venturi to allow adequate flow to carry the friction reducer down stream and away from the critical Venturi injection port. The pressurized chemical injection lines are maintained within a desirable pressurized state with pumps, check valves, and expansion tanks. Metering valves open and close to allow flow from the pressurized chemical lines into the Venturi injection port according to desired chemical concentration rates or chemical flow rates. This system is autonomous and maintains pressures and flows according to operator-entered setpoints, which can be modified whenever necessary through both wireless control panels (e.g. computers, tablets, and cellular phones) or the wired control system. Multiple operators can modify the setpoints or monitor the setpoints based on desired operational standards at the drill site.

The described chemical injection unit is for the purpose of injecting chemical compositions downhole during, prior to, or after drilling operations. Chemical compositions injected using the described technology include Newtonian and non-Newtonian fluids or combinations thereof.

BRIEF DESCRIPTION WITH SEVERAL VIEWS OF DRAWINGS

FIG. 1 The overall system design is shown with three chemical injection circuits (labeled A, B, and C), a dye injection system, and a water purge system.

Figure 2:
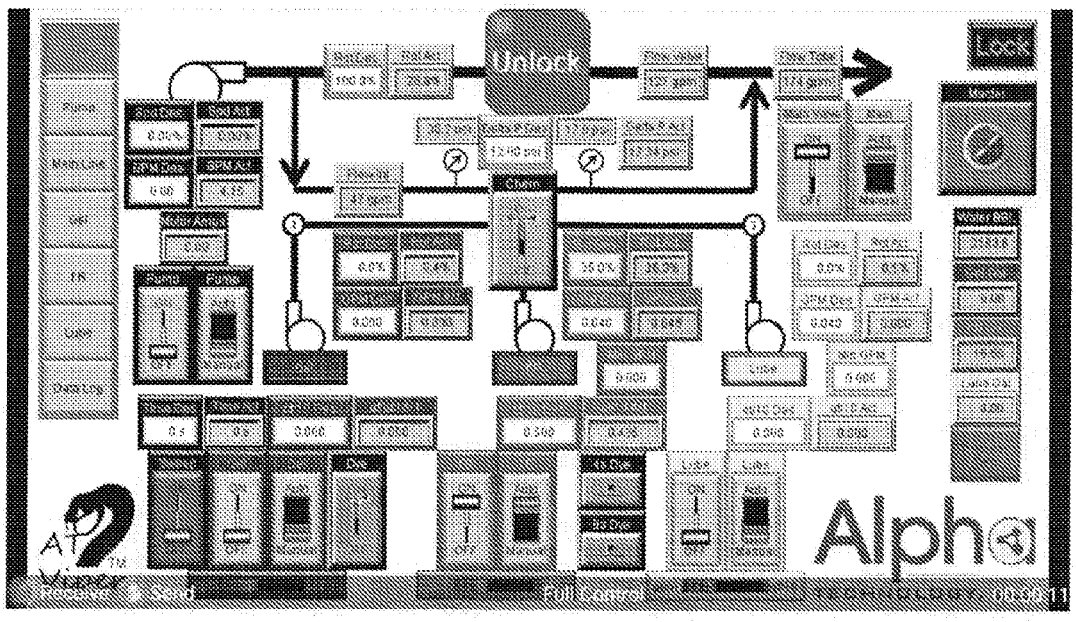

FIG. 2. An image showing the digital control panel with both setpoints and measured values. Main line water flow rate can be controlled through a combination of the boost pump pressure and the mainline flow valve state.

Figure 3:
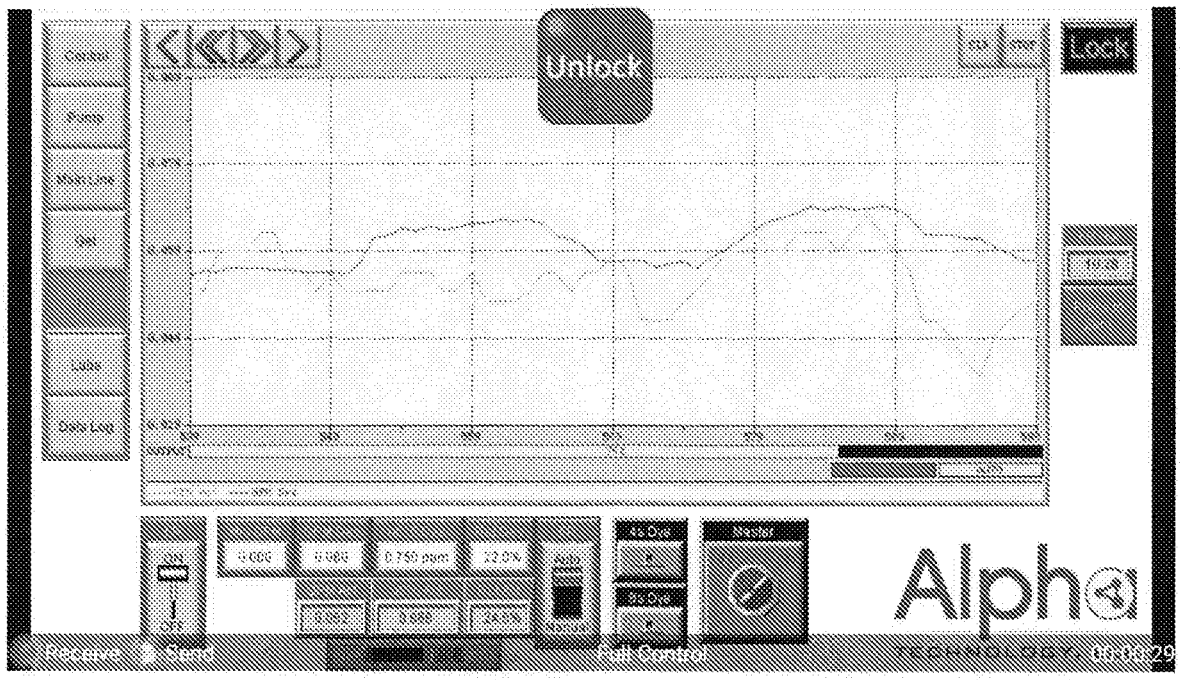

FIG. 3 A plot showing how the chemical injection rate in GPM is autonomously adjusted to maintain a constant concentration shown in qt/10 (quarts of chemical per 10 barrels of water) with a varying water flow rate.

DETAILED DESCRIPTION OF THE INVENTION

With reference to the accompanying figures, a chemical injection unit comprised of one or more pressurized chemical injection loops 10 that uses a Venturi 11 with fluid shearing (i.e. mixing) mechanism and fast-acting valve 12 with an algorithm and control system means to eliminate chemical polymerization until the polymer is swept away in the main line flow pipe 13 and adjusts chemical injection based on water flow to maintain a consistent chemical concentration even with varying water flow rates, is shown in FIG. 1.

In this embodiment, the chemical injection unit is further comprised of at least one or a plurality of pumps 14 (e.g. gear, diaphragm, among others) to build pressure in the chemical lines 15, motorized metering valves 16 to control flow rates, flow sensors 17, a fast-acting valve 12 to control chemical exposure to water, solenoid valves 18 to provide quick flow response, an electronic control system (that reads sensor data, compares the sensor data to desired set points, and adjusts actuator actions accordingly to optimally chosen coefficients of a proportional, integral, and derivative control scheme), a local wireless network, and custom user interface system for remote and local control FIG. 2, monitoring, and data logging shown in FIG. 3.

The chemical injection loop 10 is further comprised of a boost pump 19 to boost pressure above atmospheric (e.g. a pump), flow sensors 20 for measuring real-time flow rates, metering valves 21 to control fluid flow, a main line flow pipe 13 with an in-line main line valve 22 for controlling the amount of flow that is directed across the Venturi 11. A fast-acting (FA) valve 12 is used to separate the chemical lines 15 from the water flow path. Electronic pressure gauges (PGs) 23 are used to measure pressure on either side of the Venturi 11 and are used to control the state of the FA valve 12. The control system closes the FA valve 12 when Venturi flow is below a threshold value and opens the FA valve 12 when flow is above the threshold value. This threshold value is chosen so a negative gauge pressure exists at the injection port of the Venturi 11. Thus far the system described has been used on many active drill sites to inject and mix precisely metered chemicals consisting of many types of friction reducers, viscosity modifiers, pipe-on-pipe lubricants, and dyes. Any Newtonian and non-Newtonian fluids can be injected with the invention with proper component selection and adjustment. Dye injection has been used regularly to change water color and provide a visual indication for chosen down-hole operations where water is injected down hole and circulated back above surface. One example of this dye injection is where drilled out debris from down-hole plugs is filtered and diverted from the flow path to allow continuous recycling of water in the drilling process.

Main line 13 water flow rate can be controlled through a combination of the boost pump 19 pressure and the main line 13 flow valve 22 state. Main line 13 flow rate is used along with desired chemical concentration injection rate (in quarts chemical per 10 barrels water) to calculate the desired chemical injection rate that is set by the individual motorized chemical circuit metering valves 16. The motorized chemical circuit metering valves have an open to close time less than 1 minute. Manual and automatic modes are available on the main line valve 22 and the chemical injection metering valves 16.

Real time monitoring of fluid flow rates is accomplished through the use of a minimally invasive mechanism flow sensor 20 to measure fluid flow. Methods such as ultrasonic, magnetic, Coriolis, impeller-based, or pressure-drop based flow sensors allow full-bore fluid flow and accurate flow measurement. Remotely controlled valves (actuated electrically, pneumatically, hydraulically, among others) are used to control valve opening and enable precise pressure control and fluid flow. The chemical injection unit algorithm programmed control system is further comprised of decision making means for automated control over the system: Ladder logic for control of chemical injection concentration and chemical injection timing.

FIG. 3 demonstrates a plot showing how the chemical injection rate in GPM is autonomously adjusted to maintain a constant concentration shown in qt/10 (quarts of chemical per 10 barrels of water) with a varying water flow rate.

The chemical injection unit algorithm programmed control system is further comprised of decision making means for automated control over the system: Ladder logic for control of chemical injection concentration and chemical injection timing. The control system is enabled remotely through a wireless or wired connection. Antennas and a modem are used to create a localized Wi-Fi network. Setpoints are entered with a user interface system FIG. 2. The setpoints are used in conjunction with the sensors and actuators of the chemical injection unit to control chemical flow into the main line 13.

The invention injects a multitude of chemicals into the main line 13 to modify the properties of the water. Friction reducer is injected at a rate desired to provide proper fluid viscosity or density in the drilling process where a coil unit is used to drill out plugs set during the fracking process of well completion. As the coil of tubing is lowered downhole, the amount of friction reducer as well as lubrication chemicals are adjusted throughout the drilling process to ensure desirable fluid and operational properties are maintained.

It is understood that the foregoing examples are merely illustrative of the present invention. Certain modifications of the articles and/or methods may be made and still achieve the objectives of the invention. Such modifications are contemplated as within the scope of the claimed invention.

What is claimed is:

1. A chemical injection unit comprising at least one or more chemical injection loops, wherein said one or more chemical injection loops are comprised of a chemical line to deliver a chemical, wherein said chemical line is in fluid connection to a fast acting valve, which is in fluid connection with a Venturi injector, wherein water from a main water line enters a first end of said Venturi injector and exits through a second end of said Venturi injector, wherein a control system is configured to control an electronic pressure gauge located at the first end of said Venturi injector wherein said electronic pressure gauge measures a water pressure at the first end of said Venturi injector and an electronic pressure gauge located at the second end of said Venturi injector measures a water pressure at the second end of said Venturi injector to determine whether a threshold water flow exists to maintain a consistent chemical injection rate; and wherein said control system is configured to close said fast acting valve when water flow drops below said threshold water flow to prevent said chemical from said one or more chemical injection loops from direct contact with water in said main water line based on said water pressure measurements.

2. The chemical injection unit of claim 1, where said one or more chemical injection loops are further comprised of one or a plurality of pumps to build pressure in said chemical lines.

3. The chemical injection unit of claim 2, where said one or more chemical injection loops are further comprised of a motorized chemical circuit metering valve, which controls a flow rate of said chemical in said chemical line.

4. The chemical injection unit of claim 3, where said control system modifies said chemical injection rate to maintain chemical concentration in said main line water by controlling said plurality of pumps and said motorized chemical circuit metering valve.

5. The chemical injection unit of claim 2, where said chemical injection loop is further comprised of at least one metering valve, and at least one flow sensor, which are controlled by said control system.

6. The chemical injection unit of claim 1 where said control system is further comprised of real time flow measurement means to measure flow rate within said main line, said Venturi, and said chemical injection loop.

7. The chemical injection unit of claim 1 where said control system is further comprised of ultrasonic, magnetic, Coriolis, impeller-based, or pressure-drop based flow sensors.

8. The chemical injection unit of claim 1, where said control system is comprised of decision making means to limit exposure of said chemicals of said one or more chemical injection loops to water of said main line and provide said consistent chemical injection rate.

9. The chemical injection unit of claim 1, where said control system is comprised of ladder logic.

10. The chemical injection unit of claim 1, where said control system further comprises a wireless router, a local wireless network, and at least one antenna for communication of operational set points and actual control variables and data through a user interface system.

11. The chemical injection unit of claim 10 where said user interface system allows wireless control and monitoring of said chemical injection unit by multiple users.

12. The chemical injection unit of claim 1 whereby any and all measured or calculated parameters are recorded for subsequent process optimization.

13. The chemical injection unit of claim 1 whereby said chemical injection unit injects chemicals pertinent to drilling operations, including friction reducers, viscosity modifiers, pipe-on-pipe lubricants, dyes, detergents, breakers, acids, biocides, stabilizers, corrosion inhibitors, surfactants, gelling agents, and scale inhibitors.

* * * * *